United States Patent [19]

Fossa

[11] Patent Number: 4,507,881

[45] Date of Patent: Apr. 2, 1985

[54] DEVICE FOR RETRIEVAL OF GOLF BALLS

[76] Inventor: Guiseppe Fossa, 1019 Russell Dr., Highland Beach, Fla. 33431

[21] Appl. No.: 514,934

[22] Filed: Jul. 18, 1983

[51] Int. Cl.[3] ..... A43C 11/00

[52] U.S. Cl. ..... 36/132; 36/127; 273/32 R; 273/DIG. 18; 294/1.1; 294/19.2

[58] Field of Search ..... 294/1 R, 19 R, 19 A, 294/99 R; 36/1, 113–115, 127, 132–134, 136; 224/252, 269, 918, 919; 273/32 R, 32 B, 32 D, 32 F, 162 E, 162 F, DIG. 18

[56] References Cited

U.S. PATENT DOCUMENTS

| | | | |
|---|---|---|---|
| 1,406,657 | 2/1922 | Knizek | 36/136 |
| 2,220,291 | 11/1940 | Savoy | 36/127 X |
| 2,928,655 | 3/1960 | Armstrong | 294/50.6 X |
| 3,434,753 | 3/1969 | DeCroes | 294/19 A |
| 3,520,569 | 7/1970 | Anderson | 294/19 A |
| 3,731,405 | 5/1973 | Kincaid | 36/134 X |
| 3,840,229 | 10/1974 | Phillips | 36/127 X |
| 3,851,410 | 12/1974 | Frazier | 36/133 |

FOREIGN PATENT DOCUMENTS

| | | | |
|---|---|---|---|
| 21000 | of 1900 | United Kingdom | 294/19 A |

*Primary Examiner*—Johnny D. Cherry
*Attorney, Agent, or Firm*—Eugene F. Malin

[57] ABSTRACT

A device capable of use with a golf shoe for removal of a golf ball from the ground and placement thereof on a tee by a handicapped golfer having the inability to manually remove the ball from the ground and manually placing the ball on a tee.

5 Claims, 6 Drawing Figures

DEVICE FOR RETRIEVAL OF GOLF BALLS

SUMMARY OF THE INVENTION

The invention relates to devices capable of being removably applied to a golf shoe or similarly shaped shoe provided with means for resiliently gripping a golf ball on the ground by a handicapped golfer unable to manually retrieve the ball and so constructed that the user can effect easy removal of the golf ball from said resilient means upon placing the golf ball on a tee.

The invention further relates to other devices other than applied to a golf shoe for achieving the above results.

DETAILED DESCRIPTION OF THE INVENTION

Figure 1:
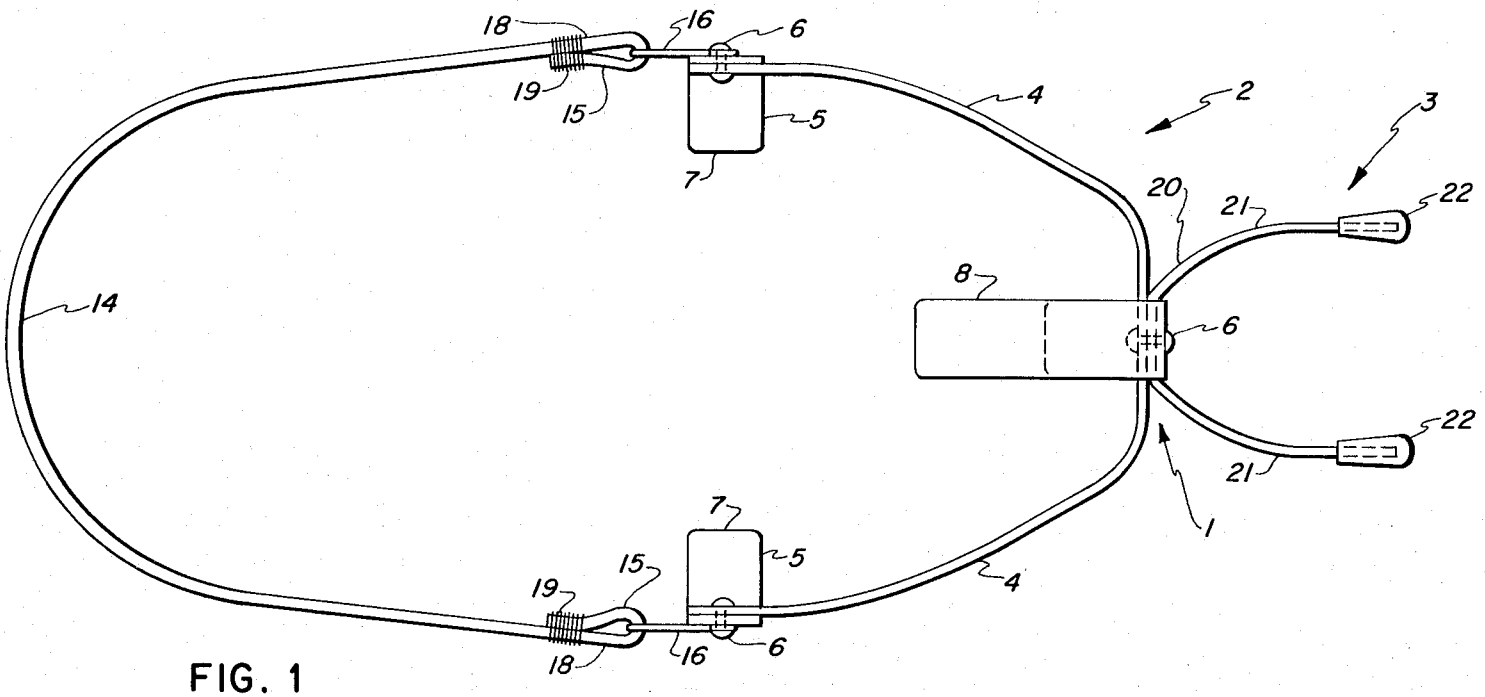
FIG. 1 illustrates a plan view of a device constructed to receive a golfshoe and golf-ball retrieval means.
Figure 2:
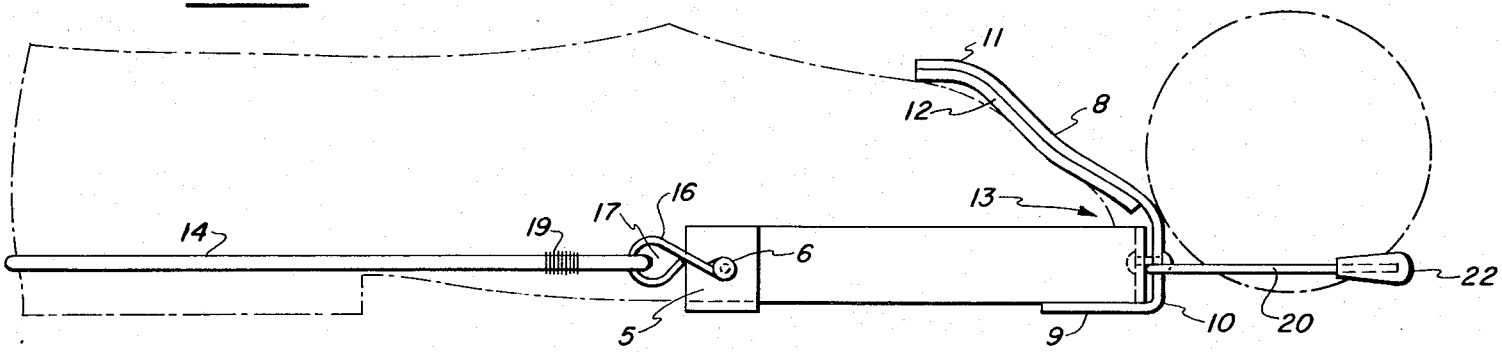
FIG. 2 illustrates a side view of FIG. 1.

Referring more specifically to the drawings, numeral 1 generally designates one embodiment of a device for retrieval of golf or similarly shaped balls and includes two essential elements 2 and 3. Element 2 is shaped and designed to maintain the device on a golf shoe and element 3 for resiliently engaging and gripping a golf ball.

Element 2 includes a generally inverted U-shaped thin flexible metal strap 4 of aluminum or any other suitable flexible material capable of flexure to substantially conform to the peripheral shape of the frontal and side portions of the front half of a golf shoe. Aluminum strap 4 is a 1/16 gauge s.s. bar having a width of about ½ inch.

Secured to strap 4 are two L-shaped angle members 5 of aluminum or other suitable metal. The vertical legs of said members are secured to the strap by suitable fastening means, for example, rivets 6. The horizontal portions 7 of the angle members have a width and length of sufficient dimensions for adequate engagement with the sole of a golf shoe, namely, a length of 5/8 inch and a width of ½ inch. The members are secured at or closely adjacent the free ends of strap 4.

A thin metal strap 8 including sections designated 9, 10, 11 of the same material as angle members 5 is secured to strap 4 similarly to angle member 5. Horizontal section 9 functions in the same manner as horizontal portions 7 of member 5. Strap 8 is secured to strap 4 at section 10 by suitable means similar to means 6.

Section 11 extends rearwardly and upwardly from the horizontal frontal portion of strap 4 first at an angle of about 30 degrees from the horizontal, then about 45 degrees from the horizontal and then parallel to section 9. Strap 8 is fabricated of a thin sheet of aluminum or any other suitable flexible material capable of flexure at section 11. Strap 8 is shaped to conform to the shape of the top surface of a golf shoe. Strap 8 is about ½ inch wide and section 11 extends rearwardly about ⅝ inch. A resilient rubber padding 12 covers the entire inner surface of section 11 preventing marring of the top surface of the golf shoe. The angular relationship of section 11 with respect to section 9 results in a space 13 for accommodating the front toe portion of a golf shoe.

A ⅛ inch diameter elastic stretchable cord 14 about 8" long is mounted to rivet 6 or equivalent fastening means at each free end 15 thereof by 16 gauge wire hooks 16. The free ends 15 of the cord are freely mounted in openings 17 of the wire hooks for permitting movement of the free ends about a horizontal axis. The free ends of cord 14 are threaded through openings 17 of hooks 16 and looped to contact an adjacent portion of the cord at 18 and secured thereto by wire thread 19 or other suitable securing means.

Element 2 is removably secured to a golf shoe by the elasticity of cord 14 frictionally engaging the heel of a golf shoe and by strap 8 engaging the front toe portion of a golf shoe.

Element 3 is a U-shaped 16 gauge wire 20 having its free ends covered with rubber or other natural or synthetic material 22 removably or otherwise secured for preventing damage to the golf ball. Element 3 is secured to the mid-section of strap 4 by rivet 6 or similar fastening means. The opposed portions or fingers 21 are spaced apart about 1½ inch or a distance slightly less than the outer diameter of a golf ball for minimal frictional engagement therewith. This minimal engagement frictionally holds the ball permitting the golfer to remove the golf ball from the ground, and after placing the ball on a golf tee, releasing the golf ball from the fingers 21 with only a very slight pressure applied by the other shoe on the surface of the golf ball without causing displacement or further insertion of the tee into the ground.

Figure 3:
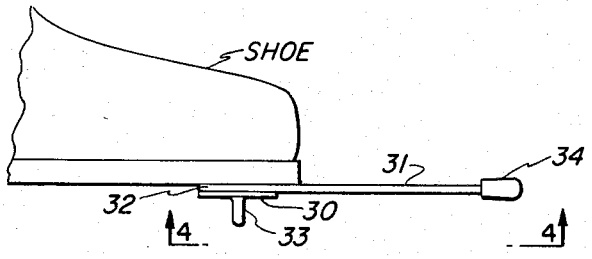
FIG. 3 is another embodiment of the invention and illustrates a golf shoe with a cleat securing golf ball retrieval means to the bottom of a golf shoe.
Figure 4:
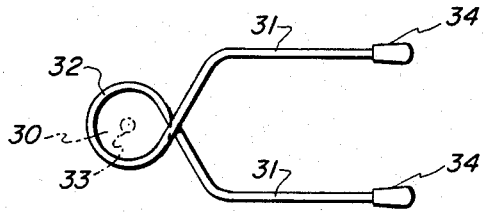
FIG. 4 illustrates the shape of the wire retrieval means adapted to be removably secured to the bottom of a golf shoe.

A second embodiment of the invention is illustrated in FIG. 3 and illustrates in dotted lines a partial outline of a golf shoe including a removable cleat 30 threadedly engaged in the bottom of a golf shoe. A wire 31 of the same gauge as wire 20 is shaped similarly to element 3 described above, and is capable of functioning similarly thereto. FIG. 4 shows wire 31 with a looped portion 32 with opening 33 which functions in the manner described below. The front cleat of a golf shoe is removed and the threaded portion thereof is passed through opening 33 and then in the threaded passage in the bottom of the golf shoe. Tightening of the cleat in the golf shoe securely clamps the wire 31 to the golf shoe. The fingers of the wire extend forwardly of the shoe similarly to element 3. The ends of the wire are also provided with rubber ends 34 like part 22 above.

Figure 5:
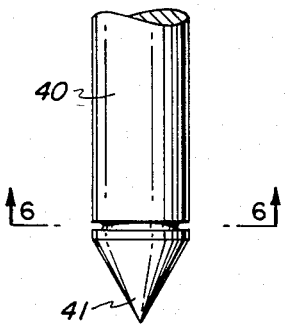
FIG. 5 is a still further embodiment of the invention and illustrates a pole with golf-ball wire retrieval means.
Figure 6:
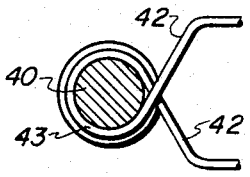
FIG. 6 illustrates a section view along line 6—6 of FIG. 5 respectively.

Still another embodiment as shown in FIG. 5, includes a pole or stick 40 having a pointed end 41 or the like shape for temporary insertion into the ground by a golfer. A wire 42 substantially identical to wire 31 as shown in FIG. 4 includes a looped portion 43 for engagement with the circumferential portion of stick 40. Wire 31 functions similar to element 3.

Other modifications of the invention including other obvious uses thereof are evident from the detailed disclosure and would be regarded within the scope of the appended claims.

What I claim is:

1. A device for retrieval of golf balls or similarly shaped objects from the ground comprising resilient flexible means having a shape substantially corresponding to the outer perimeter of a golf ball and normally of a dimension slightly smaller than the diameter of a golf ball, said means being formed of a material and so constructed and arranged that application of manual pressure to said means when in contact with a golf ball effects flexure therewith and results in frictional gripping of the golf ball thereby permitting removal of a golf ball from the ground and means supporting said flexible means wherein said means supporting said flexible means is so structured to engage the sole of a golf shoe or similarly shaped shoe and means for releasably retaining said means supporting said flexible means on the shoe, wherein said supporting means comprises an inverted U-shaped flexible strap having free ends and so shaped for engaging the opposed sides of a shoe, means secured to the free ends and the intermediate portion of said strap for engagement with the sole of a shoe, said means secured to said intermediate portion of said strap further including means constructed and so shaped for engaging the top surface of a shoe, and stretchable means secured to the free ends of said strap for frictionally engaging the heel area of a shoe thereby permitting said support means to be removably secured to a shoe.

2. A device as recited in claim 1 wherein said flexible means is substantially U-shaped and wire like in cross-section and wherein the base of the U-shaped flexible means is secured to the intermediate portion of said strap.

3. A device as recited in claim 2 including a protective layer completely covering each end of said flexible means thereby protecting a golf ball from surface damage thereof.

4. A device as recited in claim 1 which includes a wire hook secured to the free ends of said flexible strap, said wire hook including an opening, said stretchable means mounted in said opening whereby the stretchable means may be freely moved about a horizontal axis of said opening.

5. A device as recited in claim 4 wherein said means constructed for engaging the top surface of a shoe is in the form of a narrow strap and includes attached to the underside thereof a protective layer for preventing marring of the upper surface of a shoe and further wherein said stretchable means is an elastic cord.

* * * * *